United States Patent [19]

Showalter

[11] Patent Number: 4,471,734

[45] Date of Patent: Sep. 18, 1984

[54] ANTI-ROLL-UP VORTEX PISTON

[75] Inventor: Merle R. Showalter, Madison, Wis.

[73] Assignee: Automotive Engine Associates, Madison, Wis.

[21] Appl. No.: 407,492

[22] Filed: Aug. 12, 1982

[51] Int. Cl.[3] ..... F02B 17/00

[52] U.S. Cl. ..... 123/193 P; 123/306; 123/307

[58] Field of Search ..... 123/193 P, 193 CP, 671, 123/306, 307

[56] References Cited

U.S. PATENT DOCUMENTS

| | | | |
|---|---|---|---|
| 2,662,514 | 12/1953 | Bodine | 123/193 P |
| 3,919,982 | 11/1975 | Goto et al. | 123/193 P |
| 4,236,490 | 12/1980 | Correll | 123/193 CP |

*Primary Examiner*—Craig R. Feinburg
*Assistant Examiner*—David A. Okonsky
*Attorney, Agent, or Firm*—Witherspoon & Hargest

[57] ABSTRACT

Modifications of piston top geometry eliminate the formation of the coherent roll-up vortex characteristic of most engines and dissipatively mix absorbed HC from the cylinder wall with hot gases in the cylinder to reduce unburned HC emissions.

2 Claims, 5 Drawing Figures

SECTION A–A FIG. 1c

SECTION B–B FIG. 1d

SECTION C–C FIG. 1e

ANTI-ROLL-UP VORTEX PISTON

BACKGROUND AND OBJECTS

Figure 1A:
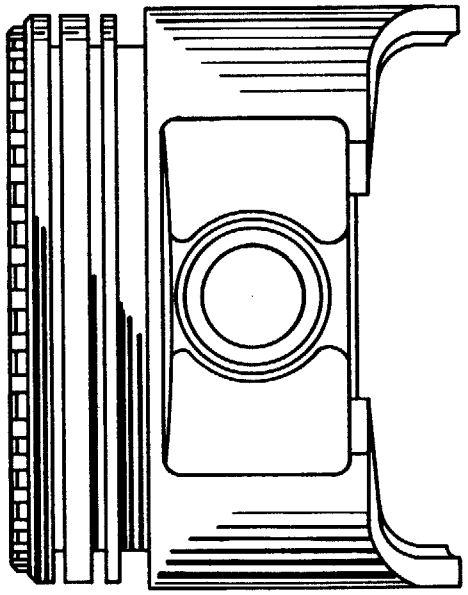

Control of emissions from internal combustion engines has long been known to be a serious and difficult practical problem. The three major emissions (pollutants) from automobile engines are hydrocarbons, carbon monoxide, and oxides of nitrogen. These three pollutants are formed in substantially different physical processes. Oxides of nitrogen are formed by the endothermic reaction of nitrogen and oxygen in the hot post-flame gases at relatively high temperatures; formation of oxides of nitrogen as a function of temperature and concentration trajectories of individual lumps of gases burning in the cylinder.

Carbon monoxide emissions come primarily from burning of excessively rich lumps of gases in the main charge; uniformly lean combustion therefore reduces carbon monoxide to acceptable values. The mechanisms by which carbon monoxide is formed in engines are well understood matters of first-order chemistry having to do with incomplete CO burnout in rich zones of the combustion gases.

The production and emission of unburned hydrocarbons is more difficult to understand. At the temperatures and pressures characteristic of combustion in an internal combustion engine and of the exhaust blowdown event in an internal combustion engine, unburned hydrocarbon molecules should be completely reacted, provided sufficient oxygen is present and uniformly mixed throughout the charge. The chemical kinetic rates of hydrocarbon oxidation at these temperatures are exceptionally fast. Nonetheless, unburned hydrocarbon emissions are a difficult practical problem. HC control has historically imposed constraints on the control strategies for NOx emissions.

It has been known for some years that the exhaust hydrocarbon concentrations from an engine are found predominantly in two lumps: one occurs just after exhaust valve opening and the other occurs towards the very end of the exhaust stroke. Strong experimental evidence suggests that these two lumps of hydrocarbon together incorporate more than 95 percent of the total unburned hydrocarbon emissions from the engine. Although the heterogeneous nature of the hydrocarbon exhaust process has been known for a number of years (at least since SAE Paper #720112, "Time Resolved Measurements of Hydrocarbon Mass Flow Rate In The Exhaust of a Spark Ignition Engine" by R. J. Tabazinski, J. B. Heywood and James C. Keck), and although the process of heterogeneity has been investigated in a number of engine laboratories, there is still controversy as to the exact mechanisms of unburned hydrocarbon production. However, it seems extremely clear from both data and fluid mechanical theory that a large fraction (roughly half of the unburned hydrocarbons) comes from unburned hydrocarbons which are physically adsorbed or absorbed on the cylinder wall and/or from the oil layer on the cylinder wall. It appears that both that these layers are swept into a roll-up vortex which forms on the top of the piston and starting at the cylinder wall. This roll-up vortex carries relatively cold lumps of fluid, rich in hydrocarbon, from these wall layers. Hydrocarbon in these fluid lumps is not burned in the cylinder and is therefore exhausted. Much of this unburned HC does not oxidize in the exhaust port and exhaust manifolds, and therefore produces substantial unburned hydrocarbon emissions.

The roll-up vortex is a direct consequence of the relative motion between the piston and the slower moving fluid elements (boundary layer) near the surface of the cylinder as a result of the well-known no-slip hydrodynamic boundary condition of fluid mechanics. Considering the flow from a frame of reference moving with the piston, this boundary layer flow approaches the piston at or near piston velocity, which is a sufficient velocity to produce a significant intertial flow of the boundary layer fluid in towards the center of the piston face. This inwardly flowing fluid, under the conditions characteristic of piston engines currently made, creates a coherent roll-up vortex; this vortex has a toroidal shape with the major diameter of the order of or smaller than the cylinder diameter and a minor diameter of the order of 25 percent or less of the cylinder diameter. As the piston moves upward, the vortex moves radially inward, and the minor diameter of the roll-up toroidal vortex increases as more fluid layer is rolled into the vortex. The roll-up vortex is a relatively large flow structure which, in interaction with the cylinder combustion chamber geometry, makes exhaust of at least a significant part of the HC from the cylinder wall layer unavoidable in typical engine geometries. It is important to realize that the internal flow structure of the roll-up vortex is exceptionally coherent. The vortex is not well mixed, and is heterogeneous in temperature and local concentrations of combustables. As a result, the hydrocarbons in the roll-up vortex do not oxidize (burn). The roll-up vortex therefore systematically convects unburned hydrocarbon to a place where it will be exhausted, creating hydrocarbon emissions. It is important to note that the internal structure of the roll-up vortex appears laminar, and has no significant evidence of turbulent diffusion with a normally shaped piston face. Turbulent diffusion would be needed to mix the gases and cause oxidation of hydrocarbons before exhaust has reached the cylinder. Visualization of the roll-up vortex has been known in literature at least since the SAE paper #720112 by R. J. Tabazinski, J. B. Heywood and James C. Keck.

The roll-up vortex flow structure is exceptionally coherent, and the coherence of this flow structure is remarkably independent of the more obvious typical changes in the piston face geometry with the consequence that the roll-up vortex fluid mechanics is rather uniform over the entire population of current engines.

In view of the exceptionally high kinetic oxidation rates of hydrocarbons in oxygenating environments at temperatures characteristic of the exhaust process in an engine, it is highly desirable to disrupt the coherent laminar vortex structure of the conventional roll-up vortex and create a flow field with substantial turbulence in order to achieve dispersion to mix, heat and burn the unburned hydrocarbon from the oil and/or absorbed gases in the wall layers. Moreover, it is desirable to disrupt the flow geometry of a typical roll-up vortex into a flow geometry less likely to be exhausted near top dead center of piston motion. It is the purpose of the present invention to provide simple and manufacturable piston face geometries which do disrupt the roll-up vortex, thereby controlling hydrocarbon emissions.

A number of piston face geometries have been developed by the inventors which do significantly disrupt the conventional roll-up vortex in a reciprocating piston engine. The inventors had the idea of disrupting the roll-up vortex for mixing; they applied general fluid mechanical knowledge and detailed knowledge of vortex and boundary layer laminar and turbulent fluid mechanics. Using this knowledge the inventors developed an empirical testing program employing flow visualization which produced the modified piston geometries of the current invention. In each of the piston geometries shown, the inertial flow from the cylinder boundary layer is disrupted in such a fashion that the usual roll-up vortex does not form, but is instead replaced by a multiplicity of smaller, much more turbulent, and less stable flow structures which have much increased likelihood of dispersion and mixing.

As we will also show below, these same modified piston geometries have other potential benefits for design control and improvement of in-cylinder combustion processes in automobile engines. In particular, the modified geometries provide a powerful process, not previously exploited, for controlling both homogeneity and turbulence in intensity of the in-cylinder combustion charge at spark-firing time. Homogeneity of charge is critical in order to avoid the occurrence of individual lumps of fluid that are either rich (and therefore produce hydrocarbon emissions) or only slightly lean (thereby producing oxides of nitrogen). Turbulence intensity in the combustion charge at ignition time is also important in order to create rapid and complete combustion. The speed of combustion is linearly proportional to turbulence intensity (when other variables are held constant) as shown in the SAE Paper #760160, "Effects of Turbulence on Spark-Ignition Engine Combustion," by David Lancaster.

IN THE DRAWINGS

Figure 1B:
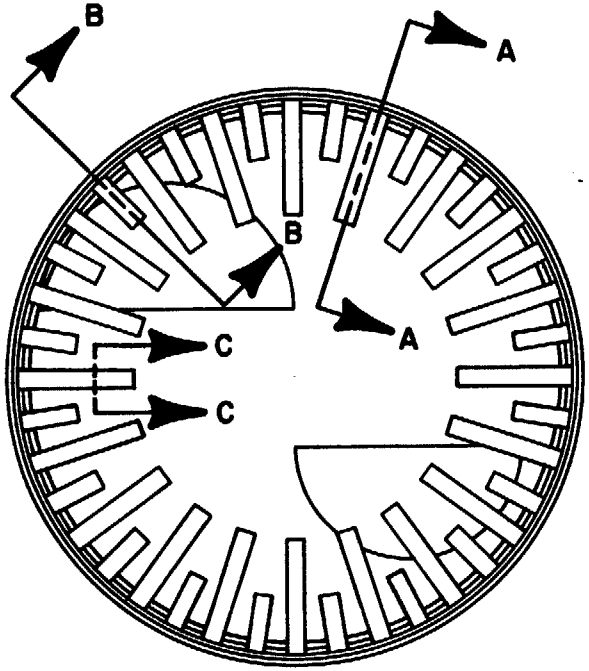
Figure 1:
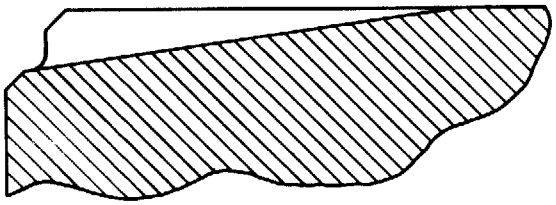
Figure 1:
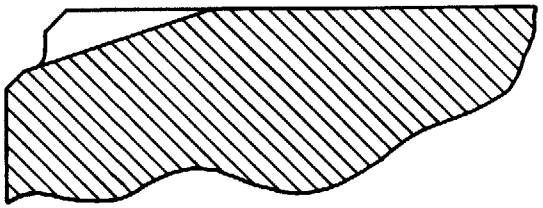
Figure 1:
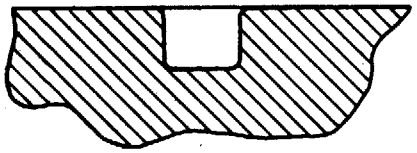

The various views of FIG. 1 show the preferred form of the present invention.

FIG. 1*a* is a side view of a piston having the pie slice mixer grooves.

FIG. 1*b* shows the top view of the piston, showing the grooves.

FIG. 1*c* shows section A—A from FIG. 1*b*.

FIG. 1*d* shows section B—B from FIG. 1*b*.

FIG. 1*e* shows section C—C from FIG. 1*b*.

DETAILED DISCUSSION

FIGS. 1*a*, 1*b*, 1*c*, 1*d*, and 1*e* show the geometry that evolved from the flow visualization tests as being particularly effective in creating mixing that destroys the roll-up vortex formed on the piston top and also in creating mixing and turbulence intensity near top dead center of the compression stroke.

The basic action in breaking up the roll-up vortex and creating mixing intended to cause oxidation of the hydrocarbons entrapped in the roll-up vortex can be described as a "pie-slicer" action. The geometry is designed so that alternating slices move radially inward and axially upward away from the piston face. The pie slice action thus creates a number of smaller disc-like structures, each of which has a very much increased surface exposed to swirl or other motions in the cylinder and thereby promoting turbulent mixing and oxidation. Moreover, the motions of each slice of fluid after the roll-up vortex is broken into slices is such that turbulent mixing along its faces is promoted even if no swirl or other gross motions are occurring in the cylinder. The break-up of the roll-up vortex into slices is achieved by the combination of cliffs and slots shown in FIG. 1*a*, 1*b*, 1*c*, 1*d*, and 1*e*. Twenty long and twenty short slots are shown in FIG. 1*b*. Portions of the roll-up vortex moving inward in the circumferential locations of these slots follow paths like that of the roll-up vortex on an unmodified piston face; that is, they move inward rolling up as they move. On the other hand those portions of the roll-up vortex that are circumferentially aligned with a "cliff" which is all those sections not aligned with slots, are forced to move upward roughly parallel with the cylinder wall. The cliff sections can be seen clearly in the side views of FIGS. 1*c*, 1*d* and 1*e*. Thus the cliff and slot geometry breaks the roll-up vortex into a number of slices (forty in the particular case shown in FIG. 1).

Visual studies of the mixing action in the presence of the alternating inward and upward moving slices, indicate that good mixing is achieved before the pieces of the broken-up vortex reach the cylinder head or pass out through the exhaust valve during exhaust strokes. The rapid chemical reactions discussed above that occur in the presence of turbulent fluctuations should then considerably reduce (or even eliminate) the emission of hydrocarbons which were originally rolled-up into the vortex motion from the wall layers.

The alternating long and short slots are shown in FIG. 1*b*, 1*c*, 1*d* and 1*e* assist the mixing action by creating somewhat different trajectories for the inward moving slices in the long grooves (FIG. 1*c*) and the short slits (FIG. 1*d*) respectively. Visual tests show considerable indifference to the precise shape of the cross section shape of the slots. The particular cross section shown in FIG. 1*e* appears to provide at least as good mixing as other cross sections tested.

A number of other configurations were tested. Other slot configurations, number of slots, cliff configurations and entirely different end configurations are capable of creating break-up of the roll-up vortex system for improved mixing and reduced HC emissions. Invention is claimed for all such possible minor geometrical variations employed for the purpose of destroying the roll-up vortex and thereby creating mixing, turbulence and oxidation pf the hydrocarbon before exhaust.

A second important purpose of the pie-slice mixers is to increase in-cylinder mixing and turbulence prior to spark firing during the compression stroke. The pie slice mixers shown in FIG. 1 definitely increase mixing in the presence of in-cylinder swirl. The motion of the swirl flow over the slots causes the ejection of fluid upward and downward parallel to the cylinder walls. This behavior of slots is well known and is a function of slot-geometry as shown in the literature by Liu, Johnston and Kline, "An Experimental Study of the Turbulent Boundary Layer on a Rough Wall," (MD-15, Stanford University Department of Mechanical Engineering, 1966). This action increases both mixing and in-cylinder turbulence intensity. The increased mixing will provide improved mixing of in-cylinder residual gases from prior strokes of the engine thereby serving two important functions in combustion: (i) increase the distribution of hot residual gases including radicals promoting ignition and combustion; (ii) increase the homogeniety of the charge thereby reducing the presence of zones that are rich and create hydrocarbons or only slightly lean and thereby create oxides of nitrogen.

The increased turbulence intensity created by the piston head slots is important in promoting rapid combustion thereby improving fuel economy and also insuring more complete combustion prior to opening of the exhaust valve. The effect of turbulence intensity is well documented in this regard by the paper of David Lancaster (SAE #760160).

I claim:

1. In a circular piston for a reciprocating piston internal combustion engine, said piston comprising a top portion, a ring carrying portion integral with the top portion and extending downwardly thereform, a skirt portion integral with and extending downwardly from said ring carrying portion, said piston top portion including a completely flat upper surface with a downwardly extending peripheral side, said top portion having a plurality of radially disposed slots extending completely around the periphery of said top portion and from the peripheral side, said slots extending downwardly from the flat upper surface wherein the slots are of varying radial length and are arranged alternately short and long throughout the upper surface of the piston top to form a plurality of troughs.

2. The invention as set forth in claim 1 and wherein the depth of the slots decreases radially inward.

* * * * *